US007741764B1

(12) United States Patent
Sung

(10) Patent No.: US 7,741,764 B1
(45) Date of Patent: Jun. 22, 2010

(54) DLC EMITTER DEVICES AND ASSOCIATED METHODS

(76) Inventor: Chien-Min Sung, 4, Lane 32, Chung-Cheng Road, Tansui, Taipei County 251 (TW)

( * ) Notice: Subject to any disclaimer, the term of this patent is extended or adjusted under 35 U.S.C. 154(b) by 732 days.

(21) Appl. No.: 11/651,920

(22) Filed: Jan. 9, 2007

(51) Int. Cl.

| | |
|---|---|
| ***H01J 9/02*** | (2006.01) |
| ***H01J 63/04*** | (2006.01) |
| ***H01J 1/62*** | (2006.01) |
| ***H01J 21/00*** | (2006.01) |
| ***H01J 9/24*** | (2006.01) |

(52) U.S. Cl. ..... 313/310; 313/495; 313/233; 313/496; 445/24; 445/25

(58) Field of Classification Search ..... None
See application file for complete search history.

(56) References Cited

U.S. PATENT DOCUMENTS

| | | | | |
|---|---|---|---|---|
| 5,411,772 | A * | 5/1995 | Cheung | 427/586 |
| 5,675,216 | A | 10/1997 | Kumar et al. | |
| 5,675,972 | A | 10/1997 | Edelson | |
| 5,686,791 | A | 11/1997 | Kumar et al. | |
| 5,713,775 | A | 2/1998 | Geis et al. | |
| 5,777,427 | A | 7/1998 | Tanaka et al. | |
| 5,844,252 | A | 12/1998 | Shiomi et al. | |
| 5,897,790 | A | 4/1999 | Koga et al. | |
| 5,925,891 | A | 7/1999 | Koga et al. | |
| 5,981,071 | A | 11/1999 | Cox | |
| 5,984,752 | A | 11/1999 | Tanaka et al. | |
| 6,064,137 | A | 5/2000 | Cox | |
| 6,103,298 | A | 8/2000 | Edelson et al. | |
| 6,116,976 | A * | 9/2000 | Sinor et al. | 445/28 |
| 6,127,773 | A | 10/2000 | Kumar et al. | |
| 6,204,595 | B1 | 3/2001 | Falabella | |
| 6,290,562 | B1 * | 9/2001 | Wells et al. | 445/24 |
| 2005/0183669 | A1 * | 8/2005 | Parkhe et al. | 118/724 |
| 2007/0126312 | A1 * | 6/2007 | Sung | 310/306 |

* cited by examiner

*Primary Examiner*—Nimeshkumar D Patel
*Assistant Examiner*—Natalie K Walford
(74) *Attorney, Agent, or Firm*—Thorpe North & Western LLP

(57) ABSTRACT

Diamond-like carbon field emission surfaces, including associated devices and methods for using such devices are disclosed. In one aspect, for example, a field emission surface is provided, including a smooth layer of diamond-like carbon disposed on a smooth substrate, the diamond-like carbon layer having a uniformly distributed ablation pattern configured to emit electrons. The diamond-like carbon layer should be smooth in order to allow the uniform distribution of the ablation pattern.

33 Claims, 2 Drawing Sheets

DLC EMITTER DEVICES AND ASSOCIATED METHODS

FIELD OF THE INVENTION

The present invention relates generally to diamond-like carbon emitter devices and methods making and using such devices. Accordingly, the present application involves the fields of physics, chemistry, electricity, and material science.

BACKGROUND OF THE INVENTION

Thermionic and field emission devices are well known and used in a variety of applications. Field emission devices such as cathode ray tubes and field emission displays are common examples of such devices. Generally, thermionic electron emission devices operate by ejecting hot electrons over a potential barrier, while field emission devices operate by causing electrons to tunnel through a barrier. Examples of specific devices include those disclosed in U.S. Pat. Nos. 6,229,083; 6,204,595; 6,103,298; 6,064,137; 6,055,815; 6,039,471; 5,994,638; 5,984,752; 5,981,071; 5,874,039; 5,777,427; 5,722,242; 5,713,775; 5,712,488; 5,675,972; and 5,562,781, each of which is incorporated herein by reference.

Although basically successful in many applications, thermionic devices have been less successful than field emission devices, as field emission devices generally achieve a higher current output. Despite this key advantage, most field emission devices suffer from a variety of other shortcomings that limit their potential uses, including materials limitations, versatility limitations, cost effectiveness, lifespan limitations, etc. For example, field emission device tend to have poor uniformity of emission. This emission limitation has greatly limited the use of field emission in most LCD device.

A variety of different materials have been used in field emitters in an effort to remedy the above-recited shortcomings, and to achieve higher current outputs using lower energy inputs. One material that has recently become of significant interest for its physical properties is diamond. Specifically, pure diamond has a low positive electron affinity which is close to vacuum. Similarly, diamond doped with a low ionization potential element, such as cesium, has a negative electron affinity (NEA) that allows electrons held in its orbitals to be shaken therefrom with minimal energy input. However, diamond also has a high band gap that makes it an insulator and prevents electrons from moving through, or out of it. A number of attempts have been made to modify or lower the band gap, such as doping the diamond with a variety of dopants, and forming it into certain geometric configurations. While such attempts have achieved moderate success, a number of limitations on performance, efficiency, and cost, still exist. Therefore, the possible applications for field emitters remain limited to small scale, low current output applications.

As such, materials capable of achieving high current outputs by absorbing relatively low amounts of energy from an energy source, and which can be used to produce a uniform emission that are suitable for use in practical applications continue to be sought through ongoing research and development efforts.

SUMMARY OF THE INVENTION

Accordingly, the present invention provides diamond-like carbon (DLC) field emission surfaces, including associated devices and methods for using such devices. In one aspect, for example, a field emission surface is provided, including a smooth layer of diamond-like carbon disposed on a smooth substrate, the diamond-like carbon layer having a uniformly distributed ablation pattern configured to emit electrons. The diamond-like carbon layer should be smooth in order to allow the uniform distribution of the ablation pattern. Although the level of smoothness may vary depending on the particular intended uses of the emission surface, in one aspect the diamond-like carbon layer may be smooth to an RA value of less than about 10 nm. In another aspect, the diamond-like carbon layer may be smooth to an RA value of less than about 5 nm. Additionally, although there may be no limits on the thickness of such a diamond-like carbon layer, in one aspect the diamond-like carbon layer may have a thickness of less than about 750 nm.

The diamond-like carbon layer may have various additional characteristics that may enhance the usefulness of such a layer, depending on a particular intended use. For example, in one aspect the diamond-like carbon layer may be a p-type semiconductor. Although various methods are contemplated for forming p-type diamond-like carbon materials, in one aspect the diamond-like carbon layer may be hydrogen terminated. In another aspect, the ablation pattern in the diamond-like carbon layer may be an n-type semiconductor. One example of a method for forming an n-type semiconductor may include oxygen terminating the ablated regions of the diamond-like carbon layer.

Various patterns of ablation on the diamond-like carbon layer are possible, depending on the desired emission pattern of the emission surface. For example, in one aspect the uniformly distributed ablation pattern may be a uniformly distributed grid pattern. In another aspect, the uniformly distributed ablation pattern may be a uniformly distributed pattern of discrete ablations. Regardless of the overall pattern of ablations, it should be noted that uniformity in the pattern may allow an even illumination in the emission characteristics of the surface. Accordingly, in one aspect the ablation pattern may be uniform across the diamond-like carbon layer to an average variance of less than about 5 μm. In another aspect, the ablation pattern may be uniform across the diamond-like carbon layer to an average variance of less than about 1 μm. In yet another aspect, the ablation pattern may be uniform across the diamond-like carbon layer to an average variance of less than about 100 nm.

The smooth substrate may be made of a variety of materials. In one aspect, for example, the smooth substrate may be a metal. In another aspect, the smooth substrate may be a semiconductor material. Numerous semiconductor materials may be utilized for the smooth substrate, including, without limitation, silicon, silicon carbide, silicon germanium, gallium arsenide, gallium nitride, germanium, zinc sulfide, gallium phosphide, gallium antimonide, gallium indium arsenide phosphide, aluminum phosphide, aluminum arsenide, aluminum gallium arsenide, gallium nitride, boron nitride, aluminum nitride, indium arsenide, indium phosphide, indium antimonide, indium nitride, cadmium selenide, cadmium sulfide, cadmium telluride, zinc oxide, zinc selenide, zinc telluride, and combinations thereof. In one specific aspect, the semiconductor material may be silicon.

The present invention also provides various devices incorporating field emission surfaces. For example, in one aspect a field emission device is provided including a cathode electrically coupled to a field emission surface according to aspects of the present invention, a phosphor-coated anode electrically coupled to and positioned to face the field emission surface, and a vacuum between the field emission surface and the anode. In one aspect, an electrical source may be electrically coupled to the cathode and to the anode.

Numerous configurations for the cathode of the field emission device are contemplated, all of which would be considered to be within the scope of the present invention. In one aspect, for example, the cathode may be a metal material. Such metal material may be any conductive metal known. In another aspect, the cathode may include a base layer and an intermediate layer. The intermediate layer may be made from a high work function metal, such as a group I or a group II metal. Such an intermediate layer may be positioned between the base layer and the diamond-like to carbon layer. Furthermore, in one aspect the smooth substrate may be the cathode. In another aspect, the smooth substrate may be physically coupled to the cathode.

Various aspects of the present invention also provide methods for making field emission surfaces and related devices. In one aspect, for example, a method of making a field emission surface as described is provided. Such a method may include, depositing a smooth diamond-like carbon layer onto a smooth substrate, and ablating a uniformly distributed pattern on the smooth diamond-like carbon layer. Additionally, in one aspect the method may further include polishing the diamond-like carbon layer to an RA value of less than about 10 nm prior to ablating. In another aspect, the method may further include polishing the diamond-like carbon layer to an RA value of less than about 5 nm prior to ablating.

In another aspect, a method of making a field emission device is provided. Such a method may include forming a field emission surface on a smooth substrate as has been described, electrically coupling a cathode to the field emission surface, positioning a phosphor-coated anode to face and be electrically coupled to the field emission surface, and applying a vacuum between the field emission surface and the anode. The method may further comprise electrically coupling an electrical source to the cathode and to the anode.

In yet another aspect of the present invention, a method of generating illumination is provided. Such a method may include introducing a current across the emission surface described herein such that photons are emitted from the uniformly distributed ablation pattern to excite an adjacent phosphor layer, thereby generating illumination.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
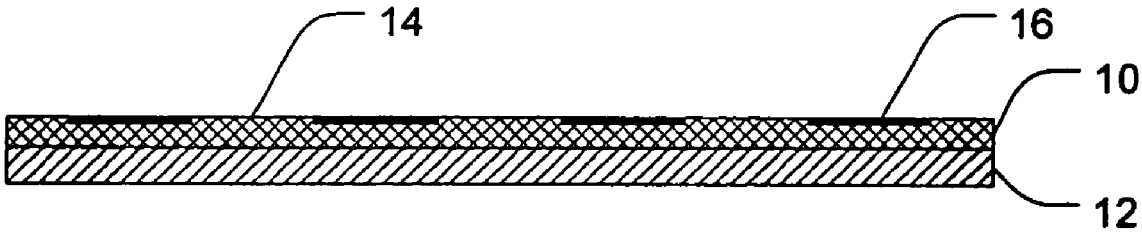
FIG. 1 shows a cross-sectional view of one embodiment of an emission surface in accordance with the present invention.

The drawings will be described further in connection with the following detailed description. Further, these drawings are not necessarily to scale and are by way of illustration only such that dimensions and geometries can vary from those illustrated.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a layer" includes one or more of such layers, reference to "a carbon source" includes reference to one or more of such carbon sources, and reference to "a cathodic arc technique" includes reference to one or more of such techniques.

DEFINITIONS

In describing and claiming the present invention, the following terminology will be used in accordance with the definitions set forth below.

As used herein, "vacuum" refers to a pressure condition of less than $10^{-2}$ torr.

As used herein, "diamond" refers to a crystalline structure of carbon atoms bonded to other carbon atoms in a lattice of tetrahedral coordination known as $sp^3$ bonding. Specifically, each carbon atom is surrounded by and bonded to four other to carbon atoms, each located on the tip of a regular tetrahedron. Further, the bond length between any two carbon atoms is 1.54 angstroms at ambient temperature conditions, and the angle between any two bonds is 109 degrees, 28 minutes, and 16 seconds although experimental results may vary slightly. The structure and nature of diamond, including its physical and electrical properties are well known in the art.

As used herein, "distorted tetrahedral coordination" refers to a tetrahedral bonding configuration of carbon atoms that is irregular, or has deviated from the normal tetrahedron configuration of diamond as described above. Such distortion generally results in lengthening of some bonds and shortening of others, as well as the variation of the bond angles between the bonds. Additionally, the distortion of the tetrahedron alters the characteristics and properties of the carbon to effectively lie between the characteristics of carbon bonded in $sp^3$ configuration (i.e. diamond) and carbon bonded in $sp^2$ configuration (i.e. graphite). One example of material having carbon atoms bonded in distorted tetrahedral bonding is amorphous diamond.

As used herein, "diamond-like carbon" refers to a carbonaceous material having carbon atoms as the majority element, with a substantial amount of such carbon atoms bonded in distorted tetrahedral coordination. Diamond-like carbon (DLC) can typically be formed by PVD processes, although CVD or other processes could be used such as vapor deposition processes. Notably, a variety of other elements can be included in the diamond-like carbon material as either impurities, or as dopants, including without limitation, hydrogen, sulfur, phosphorous, boron, nitrogen, silicon, tungsten, etc.

As used herein, "amorphous diamond" refers to a type of diamond-like carbon having carbon atoms as the majority element, with a substantial amount of such carbon atoms bonded in distorted tetrahedral coordination. In one aspect, the amount of carbon in the amorphous diamond can be at least about 90%, with at least about 20% of such carbon being bonded in distorted tetrahedral coordination. Amorphous diamond also has a higher atomic density than that of diamond (176 atoms/$cm^3$). Further, amorphous diamond and diamond materials contract upon melting.

As used herein, "vapor deposited" refers to materials which are formed using vapor deposition techniques. "Vapor deposition" refers to a process of depositing materials on a substrate through the vapor phase. Vapor deposition processes can include any process such as, but not limited to, chemical vapor deposition (CVD) and physical vapor deposition (PVD). A wide variety of variations of each vapor deposition method can be performed by those skilled in the art. Examples of vapor deposition methods include hot filament CVD, rf-CVD, laser CVD (LCVD), laser ablation, conformal diamond coating processes, metal-organic CVD (MOCVD), sputtering, thermal evaporation PVD, ionized metal PVD (IMPVD), electron beam PVD (EBPVD), reactive PVD, and the like.

As used herein, "electron affinity" refers to the tendency of an atom to attract or bind a free electron into one of its orbitals. Further, "negative electron affinity" (NEA) refers to the tendency of an atom to either repulse free electrons, or to allow the release of electrons from its orbitals using a small energy input. NEA is generally the energy difference between a vacuum and the lowest energy state within the conduction band. Those of ordinary skill in the art will recognize that negative electron affinity may be imparted by the compositional nature of the material, or the crystal irregularities, e.g. defects, inclusions, grain boundaries, twin planes, or a combination thereof.

As used herein, "work function" refers to the amount of energy, typically expressed in eV, required to cause electrons in the highest energy state of a material to emit from the material into a vacuum space. Thus, a material such as copper having a work function of about 4.5 eV would require 4.5 eV of energy in order for electrons to be released from the surface into a theoretical perfect vacuum at 0 eV.

As used herein, "electrically coupled" refers to a relationship between structures that allows electrical current to flow at least partially between them. This definition is intended to include aspects where the structures are in physical contact and those aspects where the structures are not in physical contact. Typically, two materials which are electrically coupled can have an electrical potential or actual current between the two materials. For example, two plates physically connected together by a resistor are in physical contact, and thus allow electrical current to flow between them. Conversely, two plates separated by a dielectric material are not in physical contact, but, when connected to an alternating current source, allow electrical current to flow between them by capacitive means. Moreover, depending on the insulative nature of the dielectric material, electrons may be allowed to bore through, or jump across the dielectric material when enough energy is applied.

As used herein, "asperity" refers to the roughness of a surface as assessed by various characteristics of the surface anatomy. Various measurements may be used as an indicator of surface asperity, such as the height of peaks or projections thereon, and the depth of valleys or concavities depressing therein. Further, measures of asperity include the number of peaks or valleys within a given area of the surface (i.e. peak or valley density), and the distance between such peaks or valleys.

As used herein, "RA" refers to a measure of the roughness of a surface as determined by the difference in height between a peak and a neighboring valley.

As used herein, "metallic" refers to a metal, or an alloy of two or more metals. A wide variety of metallic materials are known to those skilled in the art, such as aluminum, copper, chromium, iron, steel, stainless steel, titanium, tungsten, zinc, zirconium, molybdenum, etc., including alloys and compounds thereof.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is to individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

The Invention

As has been described, methods for constructing a field emission surface having a uniform distribution of emission have proven elusive. Various attempts at producing an emission surface with sufficient uniformity have included metal cones, carbon nanotubes, cracked oxide films, etc. However, none of these techniques have been able to achieve levels of uniformity that allow very high levels of uniform emission.

The present invention thus provides emission surfaces that overcome many of the deficiencies of previous field emission devices. Such emission surfaces are capable of emitting electrons in a uniform pattern that makes them highly useful in LCD applications. Accordingly, one aspect of the present invention provides a field emission surface including a smooth layer of diamond-like carbon disposed on a smooth substrate, with the diamond-like carbon layer having a uniformly distributed ablation pattern that is configured to emit electrons. The diamond-like carbon layer has a low work function, and thus can effectively emit electrons from the ablated regions of the ablation pattern. Because the ablation pattern can be formed very precisely, a high uniformity in the pattern of emission can be achieved. Additional details regarding amorphous diamond and diamond-like carbon layers used in energy conversion and emission can be found in U.S. Pat. No. 6,949,873 filed on Jun. 11, 2003, and U.S. patent application Ser. No. 11/157,179, filed Jun. 20, 2005, both of which are incorporated herein by reference in their entirety.

Amorphous diamond materials can be used to generate electron emission upon input of a sufficient amount of energy. The utilization of a number of materials have been attempted for this purpose, including the diamond materials and devices disclosed in WO 01/39235, which is incorporated herein by reference. Due to its high band gap properties, diamond is unsuitable for use as an electron emitter unless modified to reduce or alter the band gap. Various techniques for altering diamond band gap, such as doping the diamond with various dopants, and configuring the diamond with certain geometric aspects have yielded electron emitters of questionable use.

Various diamond-like carbon materials can easily emit electrons when an energy source is applied, however. Such materials retain the NEA properties of diamond, but do not suffer from the band gap issues of pure diamond. Thus, electrons energized by applied energy are allowed to move readily through the diamond-like carbon material, and be emitted using significantly lower energy inputs than those required by diamond, particularly from the ablated regions of the diamond-like carbon layer.

A variety of specific diamond-like carbon materials that provide the desired qualities are encompassed by the present invention. In one specific aspect, the diamond-like carbon material can be amorphous diamond material. One property of the amorphous diamond material that facilitates electron emission is the distorted tetrahedral coordination with which many of the carbon atoms are bonded. Tetrahedral coordination allows carbon atoms to retain the $sp^3$ bonding characteristic that may facilitate the surface condition required for NEA, and also provides a plurality of effective band gaps, due to the differing bond lengths of the carbon atom bonds in the distorted tetrahedral configuration. In this manner, the band gap issues of pure diamond are overcome, and the amorphous diamond material becomes effective for emitting electrons. In one aspect of the present invention, the amorphous diamond material can contain at least about 90% carbon atoms with at least about 20% of such carbon atoms being bonded with distorted tetrahedral coordination. In another aspect, the amorphous diamond can have at least about 95% carbon atoms with a least about 30% of such carbon atoms being bonded with distorted tetrahedral coordination. In another aspect, the amorphous diamond can have at least about 80% carbon atoms with at least about 20%, and more preferably at least about 30%, of such carbon atoms being bonded with distorted tetrahedral coordination. In yet another aspect, the amorphous diamond can have at least 50% of the carbon atoms bonded in distorted tetrahedral coordination.

Another aspect of the amorphous diamond materials of the present invention that facilitates electron emission may include the presence of certain geometric configurations. For example, asperities formed in the surface of amorphous diamond materials function to focus and thus increase the energy conversion or electron emission properties of the material. Asperities formed by ablating a pattern into an otherwise smooth layer of amorphous diamond or diamond-like carbon will thus readily emit electrons. The smooth surface of the amorphous diamond between the asperities may act to more effectively focus the emission of electrons to within the asperity regions.

Asperities are formed when an otherwise smooth layer of amorphous diamond or diamond-like carbon is ablated with a pattern. Because the ablation process forms such asperities, the resulting emission pattern of the field emission surface reflects the distribution of ablations in the pattern. The configuration and density of the asperities in the ablated regions will be variable, depending on the methods and conditions utilized to generate the ablation pattern. As such, any number of height and density combinations can be used in order to achieve a specific emission surface asperity, as required in order to generate a desired electron output. Alternatively, the ablation pattern may be formed in the smooth substrate prior to deposition of the amorphous diamond layer. Following such deposition, the uniform ablation pattern will be present in the surface of the amorphous diamond layer.

FIG. 1 shows one example of a field emission surface according to one aspect of the present invention. The emission surface may include a layer of diamond-like carbon 10 deposited on a smooth substrate 12. A uniformly distributed ablation pattern 16 is present on an otherwise smooth surface 14.

The diamond-like carbon or amorphous diamond materials used in various aspects of the present invention can be produced using a variety of processes known to those skilled in the art. However, in one aspect, the material can be made using a cathodic arc method. Various cathodic arc processes are well known to those of ordinary skill in the art, such as those disclosed in U.S. Pat. Nos. 4,448,799; 4,511,593; 4,556,471; 4,620,913; 4,622,452; 5,294,322; 5,458,754; and 6,139,964, each of which is incorporated herein by reference. Generally speaking, cathodic arc techniques involve the physical vapor deposition (PVD) of carbon atoms onto a target, or substrate. The arc is generated by passing a large current through a graphite electrode that serves as a cathode, and vaporizing carbon atoms with the current. The vaporized atoms also become ionized to carry a positive charge. A negative bias of varying intensity is then used to drive the carbon atoms toward an electrically conductive target. If the carbon atoms contain a sufficient amount of energy (i.e. about 100 eV) they will impinge on the target and adhere to its surface to form a carbonaceous material, such as amorphous diamond. Amorphous diamond can be coated on almost any metallic substrate, typically with no, or substantially reduced, contact resistance.

In general, the kinetic energy of the impinging carbon atoms can be adjusted by the varying the negative bias at the substrate and the deposition rate can be controlled by the arc current. Control of these parameters as well as others can also adjust the degree of distortion of the carbon atom tetrahedral coordination and the geometry, or configuration of the amorphous diamond material (i.e. for example, a high negative bias can accelerate carbon atoms and increase $sp^3$ bonding). By measuring the Raman spectra of the material the $sp^3/sp^2$ ratio can be determined. However, it should be kept in mind that the distorted tetrahedral portions of the amorphous diamond layer are neither $sp^3$ nor $sp^2$ but a range of bonds which are of intermediate character. Further, increasing the arc current can increase the rate of target bombardment with high flux carbon ions. As a result, temperature can rise so that the deposited carbon will convert to more stable graphite. Thus, final configuration and composition (i.e. band gaps, NEA, and emission surface asperity) of the amorphous diamond material can be controlled by manipulating the cathodic arc conditions under which the material is formed. Additionally, other processes can be used to form diamond-like carbon such as various vapor deposition processes, e.g. PVD or the like.

Following the deposition of the diamond-like carbon layer, in some cases polishing may be required. Chemical mechanical polishing (CMP) and other techniques are known in the art that may be utilized to create a smooth diamond-like carbon layer. Although the level of smoothness may vary depending on the intended use of the emission surface, in one aspect the diamond-like carbon layer may be smooth to an RA value of less than about 20 nm. In another aspect, the diamond-like carbon layer may be smooth to an RA value of less than about 10 nm. In yet another aspect, the diamond-like carbon layer may be smooth to an RA value of less than about 5 nm. Also, various thicknesses of diamond-like carbon layers may be utilized in making electron emission surfaces. In one aspect, however, the diamond-like carbon layer may have a thickness of less than about 750 nm.

Additional factors may be useful in increasing the emissive properties of the emission surface. For example, portions of the diamond-like carbon layer may be doped. In one aspect, the non-ablated portions of the diamond-like carbon layer may be a p-type semiconductor. One example of a p-type semiconductor would include hydrogen termination of the diamond-like carbon surface. Hydrogen termination of diamond-like carbon can be accomplished through the introduction of hydrogen into the CVD reaction chamber during growth of the layer. In another aspect, the ablated regions of the diamond-like carbon layer may be an n-type semiconductor. One example of such a semiconductor would include oxygen termination of the ablated regions of the diamond-like carbon layer. Oxygen termination may be accomplished by a variety of techniques, including forming the ablation pattern using oxygen plasma techniques.

Any technique of forming the ablation pattern in the diamond-like carbon surface is considered to be within the scope of the present invention. Certain techniques may be more desirable for a given application than others, however. For example, oxygen plasma techniques may be useful when an oxygen terminated ablation pattern is desired. Another technique may include laser ablation with, for example, an excimer laser. Additionally, it may also be possible to utilize physical abrasion or chemical etching, provided a uniformly distributed pattern can be achieved with these techniques.

Figure 2:
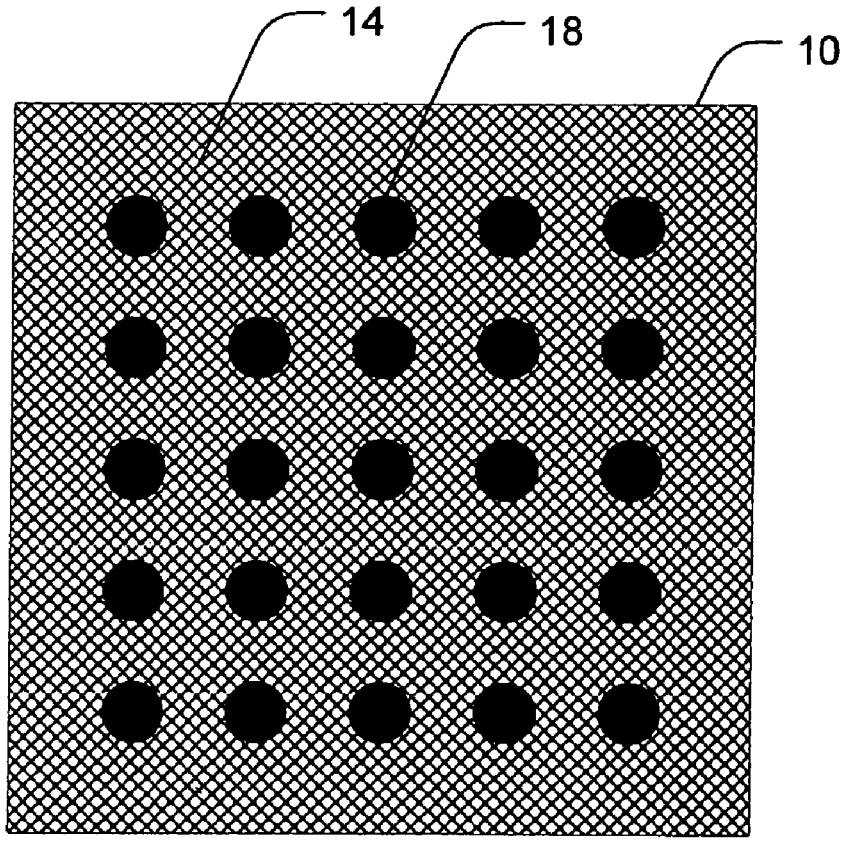
FIG. 2 shows a cross-sectional view of another embodiment of an emission device in accordance with the present invention.
Figure 3:
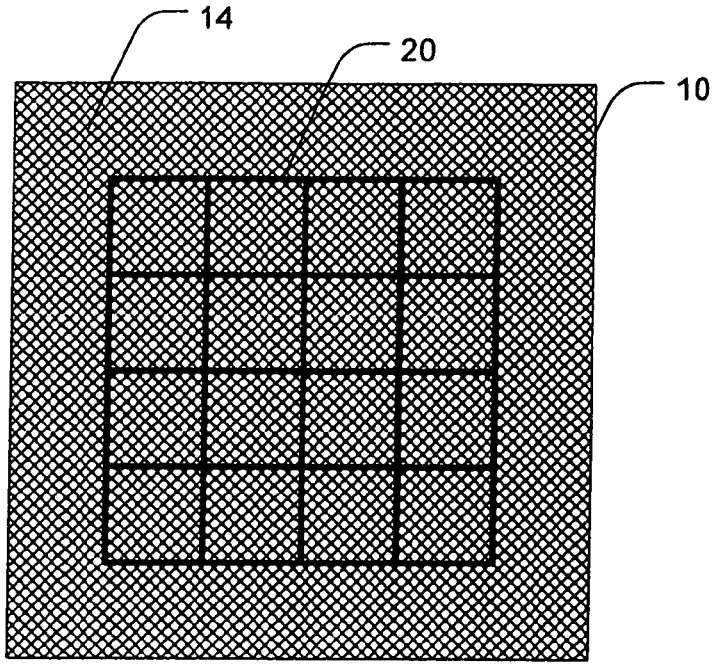
FIG. 3 shows a perspective view of yet another embodiment of an emission surface in accordance with the present invention.

The configuration of the uniformly distributed pattern may be highly variable between various types of emission surfaces, depending on the intended use of the electron emission. Any uniform pattern of ablation would thus be considered to be within the scope of the claims of the present invention. In one aspect, for example, the uniformly distributed ablation pattern may include a uniformly distributed pattern of discrete ablations 18 in the smooth surface 14 of the diamond-like carbon layer 10, as is shown in FIG. 2. In this aspect, the ablations are shown as circular ablations; however, any geometric shape can be created, including bars, squares, triangles, ovals, etc. In another aspect, as is shown in FIG. 3, a uniformly distributed grid pattern 20 may be formed on the smooth surface 14 of the diamond-like carbon layer 10. Regardless of the form of the ablation pattern, the uniformity of electron emission is facilitated by the uniformly in the distribution of the pattern. Although the tolerances of such a distribution may vary depending on the intended use of the emission surface, in one aspect the ablation pattern may be uniform across the diamond-like carbon surface to an average variance of less than about 5 μm. In another aspect, the ablation pattern may be uniform across the diamond-like carbon layer to an average variance of less than about 1 μm. In yet another aspect, the ablation pattern may be uniform across the diamond-like carbon layer to an average variance of less than about 100 nm. Numerous materials may be used in the construction of the smooth substrate. By depositing the diamond-like carbon onto a substrate that has been smoothed, polishing of the diamond-like carbon may be minimized. As such, it may be beneficial to polish the surface of a substrate prior to depositing the diamond-like carbon thereon. In one aspect of the present invention, the smooth substrate may be a semiconductor material. Non-limiting examples of such semiconductor materials include silicon, silicon carbide, silicon germanium, gallium arsenide, gallium nitride, germanium, zinc sulfide, gallium phosphide, gallium antimonide, gallium indium arsenide phosphide, aluminum phosphide, aluminum arsenide, aluminum gallium arsenide, gallium nitride, boron nitride, aluminum nitride, indium arsenide, indium phosphide, indium antimonide, indium nitride, cadmium selenide, cadmium sulfide, cadmium telluride, zinc oxide, zinc selenide, zinc telluride, and combinations thereof.

In another aspect, the smooth substrate may be an oxide material. Numerous oxides may be formed into such a substrate, and no limitation is intended by those exemplary oxides listed herein. Exemplary oxides may include, therefore, aluminum monoxide, cadmium oxide, cobalt(II) oxide, copper(II) oxide, iron(II) oxide, magnesium oxide, nickel(II) oxide, palladium(II) oxide, silver(II) oxide, strontium oxide, tin(II) oxide, titanium(II) oxide, vanadium(II) oxide, zinc oxide, aluminium oxide, chromium(III) oxide, gallium(III) oxide, indium(III) oxide, iron(III) oxide, nickel(III) oxide, titanium(III) oxide, tungsten(III) oxide, vanadium(III) oxide, yttrium(III) oxide, and combinations thereof. In one specific aspect, the smooth substrate may be palladium(II) oxide.

In yet another aspect, the smooth substrate may be a metal material. When a metal material is used as the smooth substrate, the ohmic contact resistance may cause heat buildup between the layers. Such ohmic contact resistance may be reduced through a number of techniques, including increasing the chemical compatability between the layers, e.g. by depositing a carbide interlayer, or by diffusional bonding, e.g. carbon implementation during diamond-like carbon deposition, or by heat treatment. Additionally, electron movement between the metal substrate and the diamond-like carbon layer may be facilitated by depositing a high work function metal therebetween. Examples of high work function metals may include, without limitation, Group I and II metals.

Metal materials used for the smooth substrate may be any conductive metal known to one of ordinary skill in the art. Examples of useful metals may include, without limitation, Ni, Mo, Cu, Zn, Pd, Ag, W, Ta, Pt, Au, Ti, Fe, Cr, Co, and alloys and combinations thereof. In one aspect, the metal may include Ni, Mo, Cu, Ag, W, Cr, and alloys and combinations thereof. In one specific aspect, the metal may be Ni or an alloy containing Ni.

Figure 4:
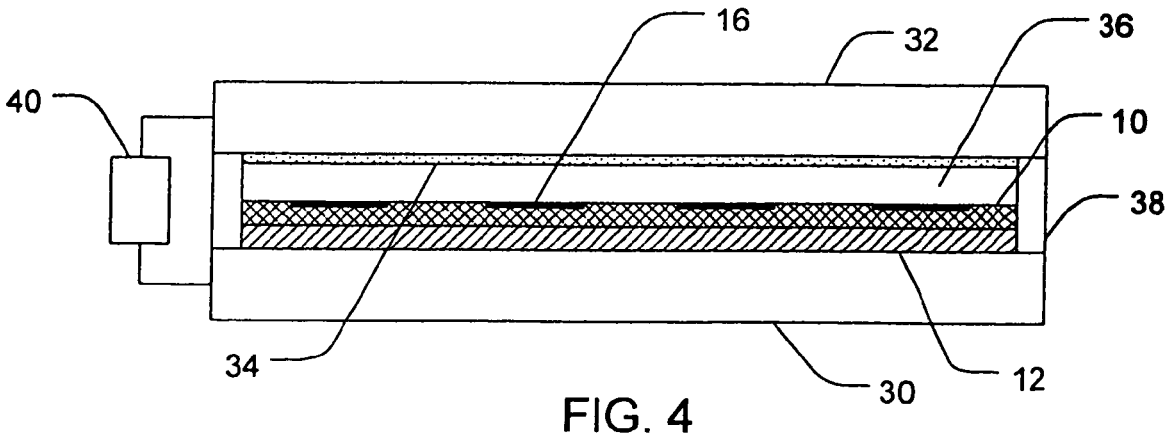
FIG. 4 shows a perspective view of a further embodiment of an emission surface in accordance with the present invention.

The emission surfaces of the present invention may be incorporated into a variety of devices, including field emission devices. As is shown in FIG. 4, for example, a field emission device may include a cathode 30 that is electrically coupled to the smooth substrate 12 of a field emission surface as described herein. In one specific aspect, the smooth substrate may be the cathode (not shown). A phosphor-coated anode 32 may be electrically coupled to and positioned to face the diamond-like carbon layer 10 of the field emission surface, with the phosphor coating 34 positioned to face the diamond-like carbon layer 10. Additionally, a vacuum may be applied to the space 36 between the anode 32 and the diamond-like carbon layer 10. An enclosure 38 may be applied around the edges of the space 36 to facilitate the application of the vacuum. In another specific aspect, an electrical source 40 is electrically coupled to the cathode 30 and the anode 32. The electrical source 40 may be used to generate an electrical potential, and thus cause the emission of electrons from the uniform ablation pattern 16 of the diamond-like carbon layer 10. This field of emitted electrons excites the phosphor coating 34 thus generating illumination representative of the uniform ablation pattern 16.

In those aspects where the cathode 30 and the smooth substrate 12 are distinct layers, coupling therebetween may occur by any means known. For example, in one aspect the cathode may be coupled to the smooth substrate by brazing, gluing, or otherwise affixed to one another using methods which do not interfere with the electrical functioning of the layers.

Additionally, either of the cathode or the smooth substrate may be formed directly upon the other using any number of known techniques such as, but not limited to, vapor deposition, thin film deposition, preformed solids, powdered layers, screen printing, electrodeposition, or the like. In one aspect, layers may be formed using deposition techniques such as PVD, CVD, or any other known thin-film deposition process. In one aspect, the PVD process is sputtering or cathodic arc.

Furthermore, the present invention encompasses methods for making the emission devices disclosed herein, as well as methods for the use thereof. A number of devices that operate on the principles of emitting electrons may beneficially utilize the diamond-like carbon and amorphous diamond materials of the present invention. A number of such devices will be recognized by those skilled in the art, including without limitation, transistors, ultra fast switches, ring laser gyroscopes, current amplifiers, microwave emitters, luminescent sources, and various other electron beam devices.

The following are examples illustrate various methods of making emission devices in accordance with the present invention. However, it is to be understood that the following are only exemplary or illustrative of the application of the principles of the present invention. Numerous modifications and alternative compositions, methods, and systems can be devised by those skilled in the art without departing from the spirit to and scope of the present invention. The appended claims are intended to cover such modifications and arrangements. Thus, while the present invention has been described above with particularity, the following Examples provide further detail in connection with several specific embodiments of the invention.

Example 1

A polished Si wafer of (100) orientation to an Ra of 1 nm is patterned with IC lithography to form a dense grid of grooves with a spacing of about one micron apart, with the groves having a width of about 100 nm. The surface of the Si wafer containing the grooves is then coated with amorphous diamond by filtered cathodic arc such that the grooves now have a width of about 5-10 nm. An indium tin oxide (ITO) glass electrode coated with YAG phosphor is positioned adjacent to the amorphous diamond surface. The gap between the ITO electrode and the amorphous diamond surface is controlled using glass spacers. The gap is sealed and a vacuum of high micro torrs is applied. The amorphous diamond-coated Si wafer is connected to a cathode, and the ITO glass electrode is connected to an anode. In operation, field emissions from the nano gaps in the amorphous diamond surface will illuminated the phosphors uniformly to generate light.

Example 2

A device is constructed as described in Example 1, with the exception that the amorphous diamond coating is compartmentalized into individual pixels. The addressing of each pixel is accomplished by two series of parallel micro electrodes oriented such that each series is perpendicular to the other. Such a device may be used as a front panel display.

Example 3

A polished Si wafer of (100) orientation to an Ra of 1 nm is coated with a layer of amorphous diamond by filtered cathodic arc. An excimer laser is used to ablate a grid pattern into the amorphous diamond layer. An indium tin oxide (ITO) glass electrode coated with YAG phosphor is positioned adjacent to the amorphous diamond surface. The gap between the ITO electrode and the amorphous diamond surface is controlled using glass spacers. The gap is sealed and a vacuum of high micro tons is applied. The amorphous diamond-coated Si wafer is connected to a cathode, and the ITO glass electrode is connected to an anode.

Example 4

A grid pattern is ablated into a polished Si wafer of (100) orientation with an excimer laser. The Si wafer is then coated with a layer of amorphous diamond by filtered cathodic arc. The grid pattern is thus reflected in the surface of the amorphous diamond layer. An indium tin oxide (ITO) glass electrode coated with YAG phosphor is positioned adjacent to the amorphous diamond surface. The gap between the ITO electrode and the amorphous diamond surface is controlled using glass spacers. The gap is sealed and a vacuum of high micro tons is applied. The amorphous diamond-coated Si wafer is connected to a cathode, and the ITO glass electrode is connected to an anode.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A field emission surface, comprising:

a smooth layer of diamond-like carbon disposed on a smooth substrate, the diamond-like carbon layer having a uniformly distributed ablation pattern configured to emit electrons and wherein either the diamond-like carbon layer is a p-type semiconductor and is hydrogen terminated, or wherein the ablation pattern is an n-type semiconductor and the diamond-like carbon layer is oxygen terminated.

2. The surface of claim 1, wherein the ablation pattern is distributed on the smooth substrate.

3. The surface of claim 1, wherein the diamond-like carbon layer is smooth to an RA value of less than about 10 nm.

4. The surface of claim 1, wherein the diamond-like carbon layer is smooth to an RA value of less than about 5 nm.

5. The surface of claim 1, wherein the diamond-like carbon layer is amorphous carbon.

6. The surface of claim 1, wherein the diamond-like carbon layer has a thickness of less than about 750 nm.

7. The surface of claim 1, wherein the uniformly distributed ablation pattern includes a uniformly distributed grid pattern.

8. The surface of claim 1, wherein the uniformly distributed ablation pattern includes a uniformly distributed pattern of discrete ablations.

9. The surface of claim 1, wherein the ablation pattern is uniform across the diamond-like carbon layer to an average variance of less than about 5 μm.

10. The surface of claim 1, wherein the ablation pattern is uniform across the diamond-like carbon layer to an average variance of less than about 1 μm.

11. The surface of claim 1, wherein the ablation pattern is uniform across the diamond-like carbon layer to an average variance of less than about 100 nm.

12. The surface of claim 1, wherein the smooth substrate is a semiconductor material.

13. The surface of claim 12, wherein the semiconductor material includes a member selected from the group consisting of silicon, silicon carbide, silicon germanium, gallium arsenide, gallium nitride, germanium, zinc sulfide, gallium phosphide, gallium antimonide, gallium indium arsenide phosphide, aluminum phosphide, aluminum arsenide, aluminum gallium arsenide, gallium nitride, boron nitride, aluminum nitride, indium arsenide, indium phosphide, indium antimonide, indium nitride, cadmium selenide, cadmium sulfide, cadmium telluride, zinc oxide, zinc selenide, zinc telluride, and combinations thereof.

14. The surface of claim 13, wherein the semiconductor material is silicon.

15. The surface of claim 1, wherein the smooth substrate is an oxide.

16. The surface of claim 15, wherein the oxide is palladium (II) oxide.

17. The surface of claim 1, wherein the smooth substrate is metal.

18. A field emission device, comprising:

a cathode electrically coupled to the field emission surface of claim 1;

a phosphor-coated anode electrically coupled to and positioned to face the field emission surface; and a vacuum between the field emission surface and the anode.

19. The device of claim 18, wherein the smooth substrate is the cathode.

20. The device of claim 19, wherein the cathode is metal.

21. The device of claim 20, wherein the cathode further comprises a base layer and an intermediate layer of a group I or a group II metal, the intermediate layer being positioned between the base layer and the diamond-like carbon layer.

22. The device of claim 18, wherein the smooth substrate is physically coupled to the cathode.

23. The device of claim 18, further comprising an electrical source electrically coupled to the cathode and to the anode.

24. A method of making the field emission surface of claim 1, comprising:

depositing a smooth diamond-like carbon layer onto a smooth substrate; and ablating a uniformly distributed pattern on the smooth diamond-like carbon layer.

25. The method of claim 24, further comprising polishing the diamond-like carbon layer to an RA value of less than about 10 nm prior to ablating.

26. The method of claim 24, further comprising polishing the diamond-like carbon layer to an RA value of less than about 5 nm prior to ablating.

27. The method of claim 24, wherein the ablating is by laser ablation.

28. The method of claim 24, wherein the ablating is by plasma etching.

29. A method of making a field emission device, comprising:

forming a field emission surface on a smooth substrate as in claim 24;

electrically coupling a cathode to the field emission surface;

positioning a phosphor-coated anode to face and be electrically coupled to the field emission surface; and applying a vacuum between the field emission surface and the anode.

30. The method of claim 29, wherein the cathode is the smooth substrate.

31. The method of claim 29, wherein the cathode is physically coupled to the smooth substrate opposite the field emission surface.

32. The method of claim 29, further comprising electrically coupling an electrical source to the cathode and to the anode.

33. A method of generating illumination, comprising:

introducing a current across the emission surface of claim 1 such that photons are emitted from the uniformly distributed ablation pattern to excite an adjacent phosphor layer and thereby generate illumination.

* * * * *